US006332608B1

(12) United States Patent
Tamura

(10) Patent No.: US 6,332,608 B1
(45) Date of Patent: Dec. 25, 2001

(54) SHEET FEEDING APPARATUS

(75) Inventor: Masashige Tamura, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/475,208

(22) Filed: Dec. 29, 1999

(30) Foreign Application Priority Data

Jan. 6, 1999 (JP) ..... 11-001490
Jan. 18, 1999 (JP) ..... 11-009750

(51) Int. Cl.[7] ..... B65H 7/08

(52) U.S. Cl. ..... 271/111; 271/10.13; 271/117; 271/122; 271/126; 271/152

(58) Field of Search ..... 271/10.11, 10.13, 271/110, 111, 121, 122, 117, 152, 153, 126

(56) References Cited

U.S. PATENT DOCUMENTS 3,173,684 * 3/1965 Binzoni et al. ..... 271/122
4,316,606 * 2/1982 Buys et al. ..... 271/122
4,589,650 * 5/1986 Miyoshi ..... 271/122
5,098,078 * 3/1992 Nakanishi ..... 271/10.11
5,882,004 * 3/1999 Kamei et al. ..... 271/121
5,988,628 * 11/1999 Mori ..... 271/117

* cited by examiner

*Primary Examiner*—H. Grant Skaggs
(74) *Attorney, Agent, or Firm*—Fitzpatrick, Cella, Harper & Scinto

(57) ABSTRACT

The present invention relates to a sheet feeding apparatus in which sheet feeding out means, while a sheet is conveyed by a sheet feed roller and a retard roller, feeds out a succeeding sheet to an abutting portion of the sheet feed roller and the retard roller so that a leading end of the succeeding sheet overlaps a trailing end of a preceding sheet.

17 Claims, 13 Drawing Sheets

SHEET FEEDING APPARATUS

BACKGROUND OF THE INVENTION

1. Field of the Invention

The present invention relates to a sheet feeding apparatus for the feeding of sheets such as originals or recording sheets to an image forming apparatus, such as a copier or a printer. In particular, the present invention pertains to a sheet feeding apparatus that can sequentially feed sheets so that the sheets overlap each other a constant amount, or so that there are no intervals between the sheets.

2. Related Background Art

Generally, when recording sheets are overlapped even slightly and conveyed to an image forming apparatus, the apparatus can not satisfactory perform image forming. Therefore, to prevent the double feeding of recording sheets, some image forming apparatuses include sheet feeding devices that convey recording sheets separately and at predetermined intervals.

As is shown in FIG. 16, this sheet feeding apparatus includes a pickup roller 100, for feeding recording sheets P stacked on sheet stacking means (not shown). When sheet feeding is stated, the pickup roller 100, which is generally positioned above the topmost recording sheet, descends until it abuts against the upper surface of the topmost recording sheet P, and then employs a rotational friction force to feed the recording sheet P to nips between sheet feed rollers 102 and retard rollers 104.

The recording sheets P can be regular paper, thin resin sheets used as substitutes for regular paper, postcards, cardboards, envelopes, or thin plastic sheets.

After the pickup roller 100 has fed the recording sheet P to the nips between the sheet feed rollers 102 and the retard rollers 104, it is raised and suspended above the recording sheets P, ready to feed the next (succeeding) sheet. The recording sheet P that was fed out is conveyed while it is pinched between the sheet feed rollers 102 and the retard rollers 104.

When the trailing end of the preceding recording sheet P passed under the pickup roller 100, the pickup roller 100 descends and feeds the next recording sheet. In order to precisely feed the next recording sheet P in this case, the pickup roller 100 descends to feed the next sheet a slight time period after when the trailing end of the preceding recording sheet passes under the pickup roller 100.

If a plurality of recording sheets P are fed out by the pickup roller 100, the recording sheets other than the topmost one are returned to the sheet stacking means by the retard rollers 104.

FIG. 17 is a diagram showing the arrangement of the separation portion (unit) of the sheet feeding apparatus. When sequential paper feeding is performed with this arrangement, at a specific time, immediately before the trailing end of the recording sheet conveyed by the sheet feed rollers 102 and the retard rollers 104 passes through the nips N, between the sheet feed rollers 102 and the retard rollers 104, an electromagnetic clutch 110 is turned off to cut the input of drive (driving power) to a sheet feed roller shaft 102*a* .

After the input of the driving power is cut, the recording sheet P is pulled out while the sheet feed rollers 102 are driven to be rotated by a pair of drawing rollers 106 that are located downstream of the sheet feed rollers 102. In FIG. 17, a torque limiter 108 idles upon the application of an amount of torque equal to or greater than a predetermined amount and thus prevents the transmission of the torque to the retard rollers 104, a one-way clutch 112 is provided on the sheet feed roller shaft 102*a* to reduce the load applied by the drawing roller pair 106, and a drive input belt 114 transmits the rotation of the sheet feed roller shaft 102*a* to a retard roller shaft 104*a*.

In FIG. 17, rotation in the direction in which a recording sheet is fed out is transmitted to the sheet feed rollers 102, and rotation in the direction in which a recording sheet is fed backwards is transmitted to the retard rollers 104. However, when no recording sheet is held between the sheet feed rollers 102 and the retard rollers 104, or when only one recording sheet is pinched between them, the torque limiter 108 idles, and no rotational force is transmitted to the retard rollers 104. Therefore the retard rollers 104 is driven to be rotated with the sheet feed rollers 102 or the recording sheet in the direction in which the recording sheet is fed out. When a plurality of recording sheets are inserted between the sheet feed rollers 102 and the retard rollers 104, the retard rollers 104 are rotated in the direction in which a recording sheet is returned, so that beginning with the bottom recording sheet, all the sheets, except for the topmost one, are returned to the sheet stacking means. In this manner, recording sheets can be separated and conveyed.

Since the one-way clutch 112 is provided in this arrangement, when the driving force input to the sheet feed roller shaft 102*a* is cut and the recording sheet is drawn by the drawing roller pair 106, the driving force input section is driven to be rotated via the retard rollers 104 and the torque limiter 108, and no work is performed by the separation mechanism. Therefore, a succeeding recording sheet is conveyed while overlapping a preceding recording sheet, i.e., double feeding occurs.

In order to prevent double feeding, another one-way clutch 116 is provided in the direction (conveying direction) in which the drive input side of the retard roller shaft 104*a* is not rotated forward.

In order to cope with recent requests for higher processing speeds, a current image forming apparatus is so designed that not only is the recording sheet feeding speed increased, but also the interval (hereinafter referred to as a sheet feeding interval) is reduced between the recording sheets that are separately conveyed by separation means constituted by the sheet feed rollers 102 and the retard rollers 104. Further, another image forming apparatus has been provided that has a function whereby, even when recording sheets are fed in more or less a double feeding state, the interval between the sheets can be corrected before an image is transferred to the sheet.

However, in the conventional sheet feeding apparatus, to prevent double feeding, the sheet feed roller shaft 102*a* is not re-driven until a preceding recording sheet has been completely removed by the drawing rollers 106. And because of the period of time during which the sheet feed rollers 102 are therefore halted, the ability to reduce the sheet feeding interval is limited.

In addition, since the conventional sheet feeding apparatus is so designed that double feeding is completely prevented, it can not feed a recording sheet and a succeeding recording sheet, while overlapping them a predetermined amount. Further, when a sheet feeding interval of 0 or a very small value is set, the sheet feeding interval is not stable, and only limited control of the interval is available.

SUMMARY OF THE INVENTION

To resolve the above shortcomings, it is one objective of the present invention to provide a sheet feeding apparatus that can sequentially feed recording sheets that overlap each other a predetermined amount, and that can feed recording sheets so that there is no, or only a tiny, sheet feeding interval.

To achieve the above objective, according to the present invention, a sheet feeding apparatus comprises:

sheet supporting means for supporting sheets;

separation means by a sheet feed roller that rotates in a sheet feeding direction and a retard roller that, to separate and convey sheets that are stacked in the sheet supporting means, rotates in a direction opposite to the sheet feeding direction; and sheet feeding out means for, while a sheet is being conveyed by the sheet feed roller and the retard roller, feeding out a succeeding sheet to an abutting portion of the sheet feed roller and the retard roller, so that a leading end of the succeeding sheet overlaps a trailing end of a preceding sheet.

DETAILED DESCRIPTION OF THE PREFERRED EMBODIMENTS

The preferred embodiments of the present invention will now be described in detail, while referring to the accompanying drawings.

Figure 1:
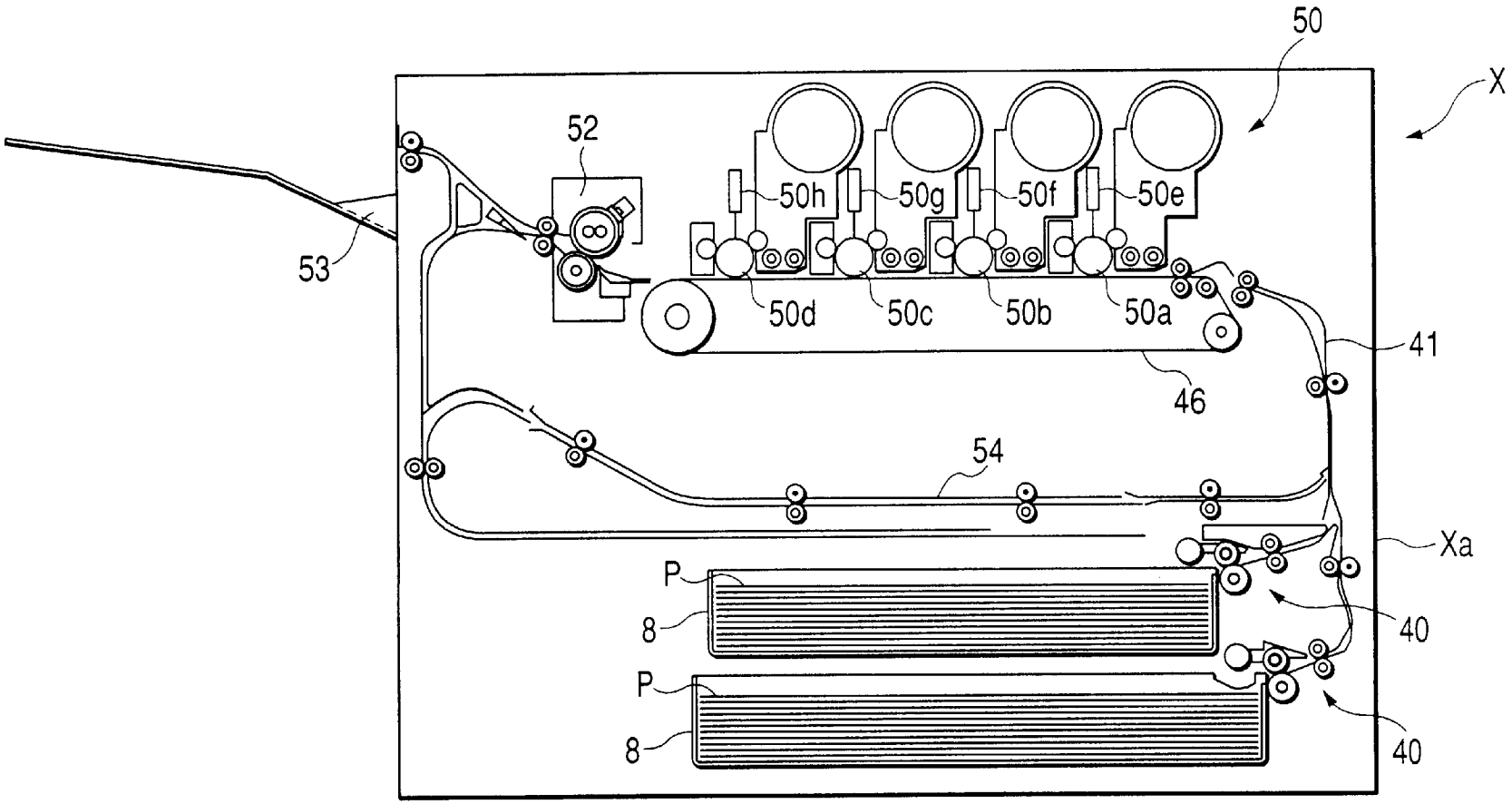
FIG. 1 is a diagram illustrating the arrangement of an image forming apparatus that includes a sheet feeding apparatus according to the present invention.

FIG. 1 is a diagram illustrating the arrangement of an image forming apparatus that includes a sheet feeding apparatus according to a first embodiment of the present invention. In FIG. 1, a portion X is an image forming apparatus and a portion Xa is the main body of the image forming apparatus X.

In the image forming apparatus X, after a recording sheet P, contained in a sheet feeding cassette 8 which is sheet supporting means is conveyed by a sheet feeding apparatus 40, the recording sheet is passed along a conveying path 41, and thereafter it is stacked on a conveying belt 46 to be conveyed to an image forming unit 50.

Further, in the image forming unit 50 of the image forming apparatus X, in accordance with an image information signal transmitted by a reader/scanner or a personal computer (not shown), toner images formed on the surfaces of four electrophotographic photosensitive drums 50*a*, 50*b*, 50*c* and 50*d*, which are image forming means, are transferred sequentially to the recording sheet P. Then a fixing unit 52 permanently fixes the toner images to the recording sheet P, and discharges the recording sheet P, on which a monochrome or full-color image is formed, to a discharge tray 53.

In FIG. 1, LEDs (Light-Emitting Diodes) 50*e*, 50*f*, 50*g* and 50*h* are positioned facing respectively the surfaces of the photosensitive drums 50*a*, 50*b*, 50*c* and 50*d*, and are independently controlled light sources for forming toner images on the surfaces of the photosensitive drums 50*a*, 50*b*, 50*c* and 50*d* respectively.

The image forming apparatus X has an automatic double-side function. To form an image on both faces of a recording sheet P, a recording sheet P in which an image is formed on one face is reversed a front surface and a rear surface of the sheet in a double-side path portion 54 provided in the main body Xa of the apparatus, and is again conveyed to the image forming portion 50, then an image is formed on its reverse face.

Figure 2:
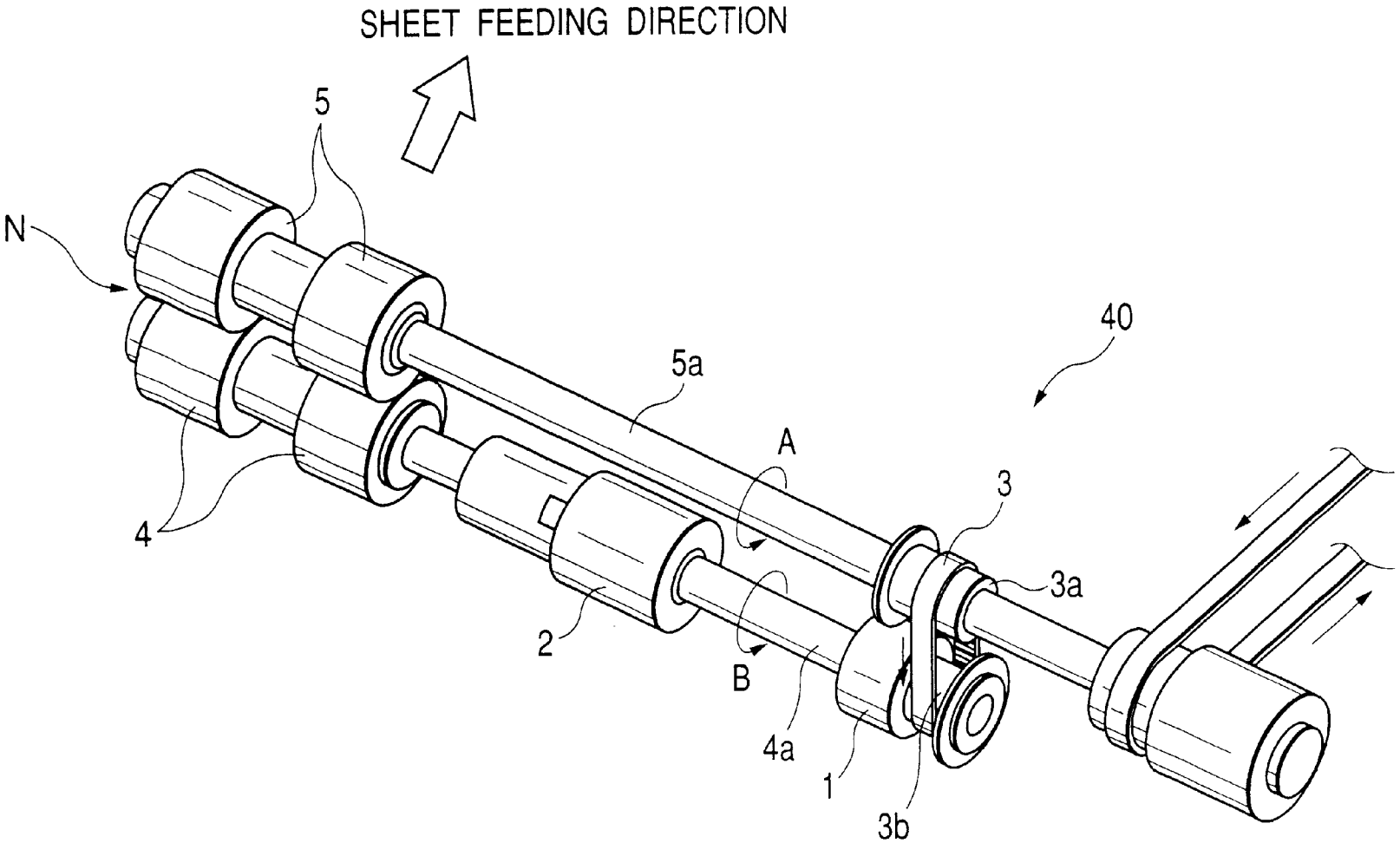
FIG. 2 is a perspective view of the essential portion of a sheet feeding apparatus according to a first embodiment of the present invention.

FIG. 2 is a perspective view of the essential portion of the sheet feeding apparatus 40 according to the present invention. Provided in FIG. 2 are: retard rollers 4, which are rotated in a direction opposite to the sheet feeding direction; a retard roller shaft 4*a;* sheet feed rollers 5, which are rotated in the sheet feeding direction, and which constitute, with the retard rollers 4, a separation means of a retard roller type; and a sheet feed roller shaft 5*a*.

Further, a drive input belt 3 is fitted around pulleys 3*a* and 3*b,* which are securely fixed around the retard roller shaft 4*a* and the sheet feed roller shaft 5*a*. With this drive input belt 3, the rotation of the sheet feed roller shaft 5*a,* which is rotated by drive means (not shown) in the direction indicated by an arrow A, is input via the pulleys 3*a* and 3*b* to the retard rollers 4. The pulleys 3*a* and 3*b* and the drive input belt 3 constitute a rotation drive input unit.

A torque limiter 2 is fitted around the retard roller shaft 4*a* between the drive input belt 3 and the retard rollers 4. Upon the application of an amount of rotation producing torque equal to or greater than a predetermined amount, the torque limiter 2 disengages and begins to idle.

An electromagnetic clutch 1 is located between the drive input belt 3 and the retard rollers 4 to control the transmission of the driving force to the retard rollers 4.

With this arrangement, while a recording sheet P is conveyed by the sheet feed rollers 5 a predetermined distance, a drive is transmitted via the drive input belt 3 to the retard roller shaft 4*a* to rotate it in the direction opposite to the rotation direction (the conveying direction) for the sheet feed rollers 5 indicated by the arrow A. As a result, the retard rollers 4 are rotated in the direction indicated by an arrow B.

When the retard rollers 4 are rotated in the direction indicated by the arrow B, i.e., in the direction opposite to the sheet feeding direction for the sheet feed rollers 5, recording sheets other than the preceding recording sheet that is to be conveyed are separated and returned upstream along the sheet feeding path.

Therefore, as will be described later, even when the next and subsequent recording sheets P, approached near the nips N between the sheet feed rollers 5 and the retard rollers 4, are conveyed through the nips N by the sheet feed rollers 5 with the preceding recording sheet, the next and subsequent recording sheets can be drawn to a position near the nips N.

When only the topmost recording sheet is being fed by the sheet feed rollers 5 as the preceding recording sheet, rotation torque equal to or greater than a predetermined amount is exerted on the retard rollers 4 via the recording sheet P. Upon the application of this torque, the retard rollers 4 is driven to be rotated with the sheet feed rollers 5 by the torque limiter 2 so that only the topmost recording sheet P is conveyed.

Figure 3:
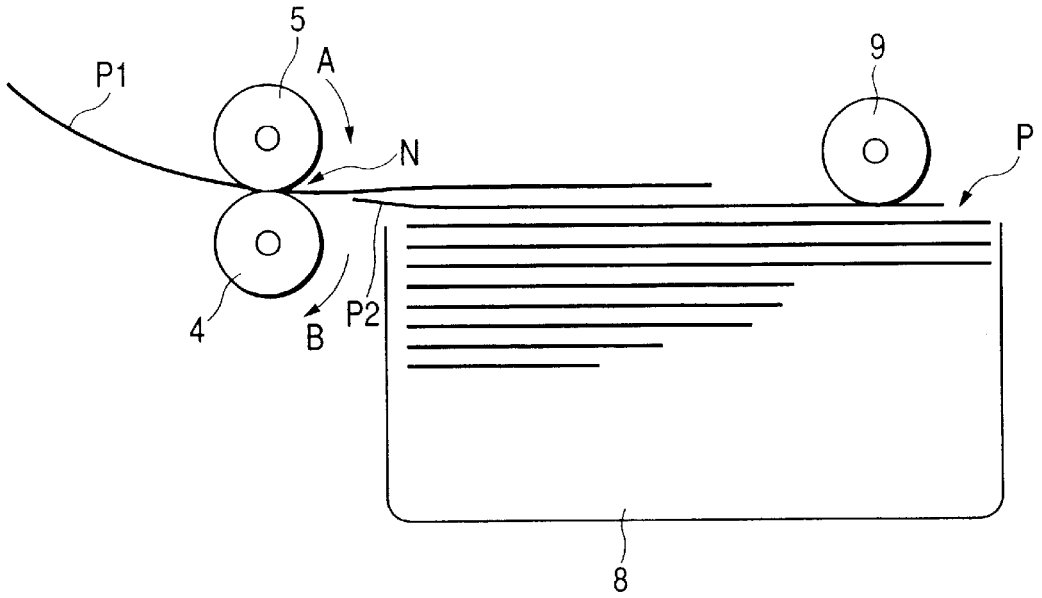
FIG. 3 is a diagram showing the sequential sheet feeding operation performed by the sheet feeding apparatus according to the first embodiment of the present invention.
Figure 4:
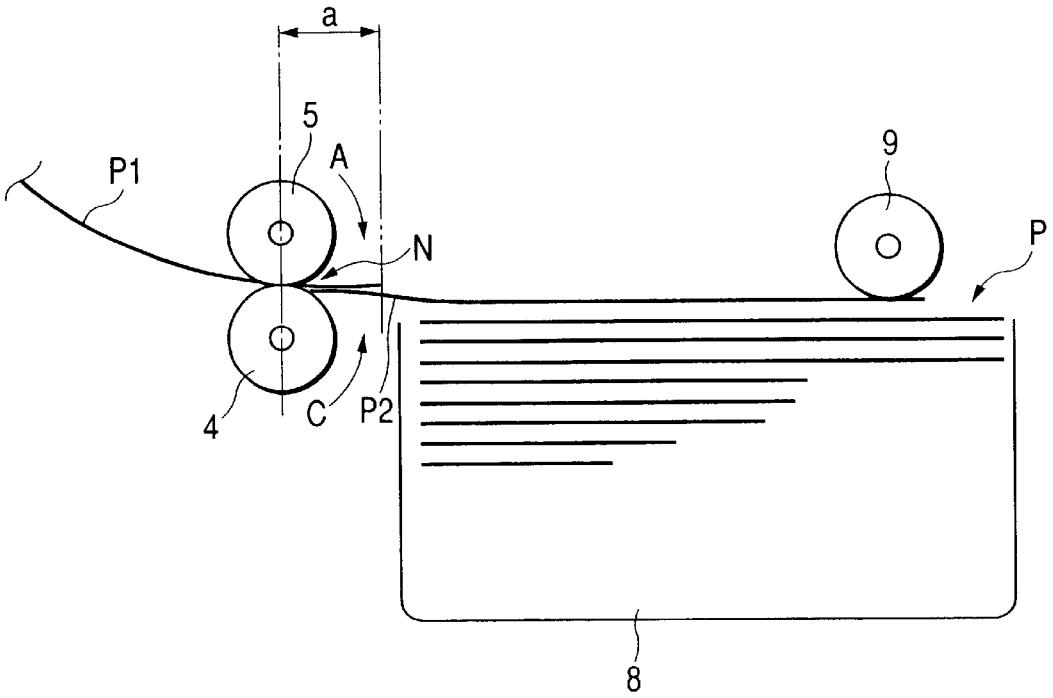
FIG. 4 is a diagram showing the sequential sheet feeding operation performed by the sheet feeding apparatus according to the first embodiment of the present invention.

In this embodiment, during the sequential paper feeding operation, as is shown in FIG. 3, the topmost recording sheet P1 among the recording sheet P mounted on a sheet stacking board 8*a* (see FIG. 5), which is the sheet supporting means and is provided in the sheet feeding cassette 8, is conveyed by the sheet feed rollers 5, and, as is shown in FIG. 4, a recording sheet to be fed next (hereinafter referred to as a succeeding recording sheet) P2 is always conveyed by a pickup roller 9 up to the nips N between the sheet feed rollers 5 and the retard rollers 4.

Figure 5:
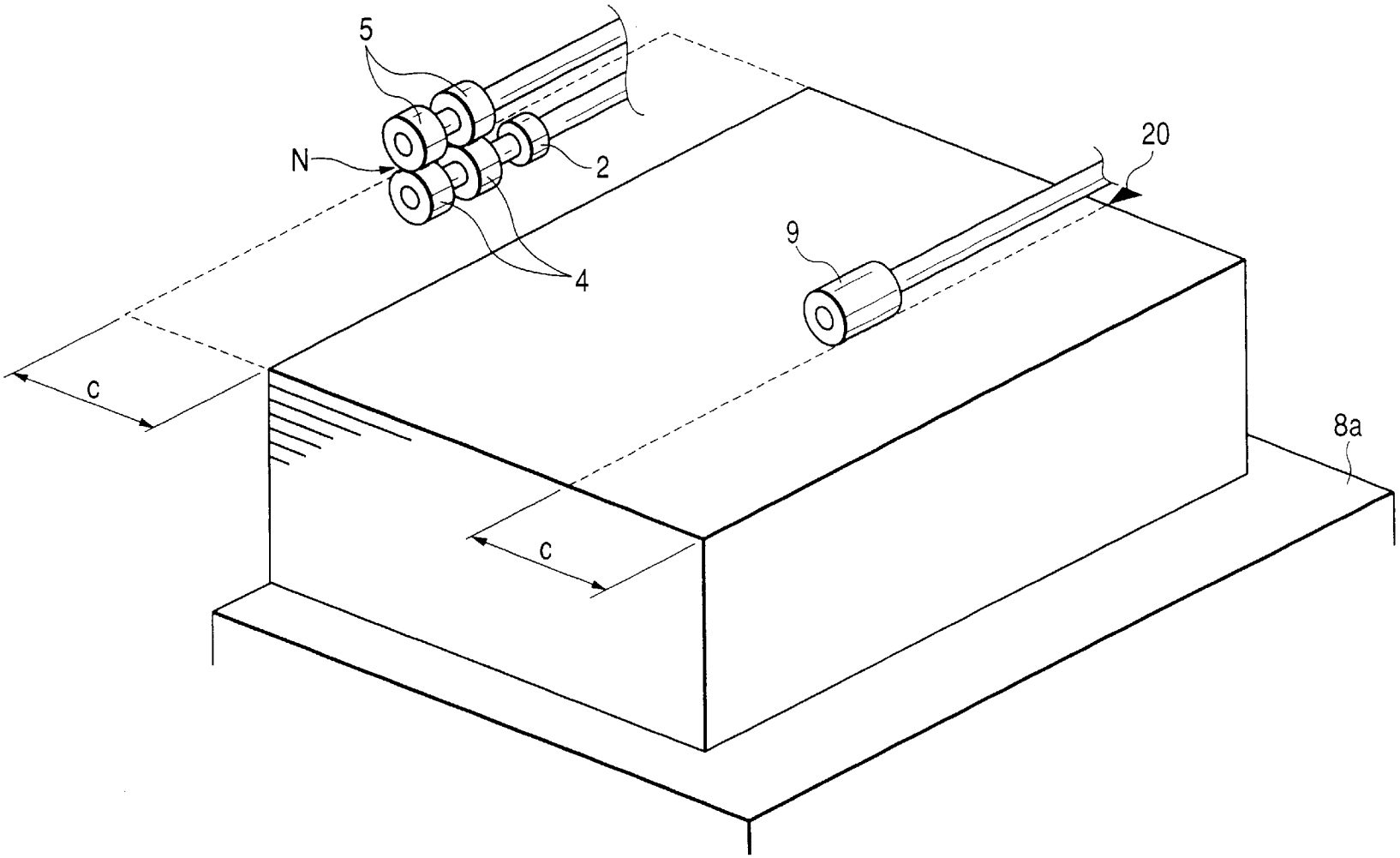
FIG. 5 is a perspective view of the sheet feeding apparatus according to the first embodiment of the present invention.

This process will be described in detail. As is shown in FIG. 5, assume that c is defined as the distance between the nips N and the leading end of a recording sheet P that is supported on the sheet stacking board 8*a* of the sheet feeding cassette 8, and that the pickup roller 9, which is the sheet feeding out means, is so located, relative to the leading end of the recording sheet P, that c is also the distance from its position to the trailing end of the recording sheet P.

When the pickup roller 9 is located at that position and is rotated, sequentially, the topmost recording sheet (hereinafter referred to as a preceding recording sheet) P1 can be sandwiched between the sheet feed rollers 5 and the retard rollers 4. And, as is shown in FIG. 4, when the trailing end of the current recording sheet P1 has passed under the pickup roller 9, the succeeding recording sheet P2 will be fed by the pickup roller 9 so that its leading end is positioned near the nip N.

Since the pickup roller 9 conveys the succeeding recording sheet P2 only up to the vicinity of the nips N, for this it does not need to exert too great a convey force, and can be so designed that little force is required to feed the recording sheet P.

The electromagnetic clutch 1, which is located between the drive input belt 3 and the retard rollers 4, is turned off when, as is shown in FIG. 4, the distance, from the trailing end of the preceding recording sheet P1 to the nips N between the rollers 4 and 5, comes to a.

After the electromagnetic clutch 1 is turned off, since no driving force is transmitted to the retard rollers 4, they are driven to be rotated with the sheet feed rollers 5 in the direction indicated by an arrow C. Subsequently, while, as previously described, the retard rollers 4 are driven to be rotated the preceding recording sheet P1 is pulled by a friction force between the succeeding recording sheet P2, which has been conveyed to a position near the nips N by the pickup roller 9, so that the succeeding recording sheet is conveyed while overlapping the preceding recording sheet P1.

After the trailing end of the preceding recording sheet P1 has passed through the nips N, the electromagnetic clutch 1 is turned on again, and the separation operation performed by the retard rollers 4 is begun again. Thus, even when three or more recording sheets were being conveyed together, the third and the following sheets are drawn back to the nips N between the rollers 4 and 5.

As is described above, since the sheet feed rollers 5 are constantly rotated and the ON/OFF state of the electromagnetic clutch 1 can be controlled as needed, the sheet feeding operation can be performed while the preceding recording sheet P1 and the succeeding recording sheet P2 are partially overlapped.

Figure 6:
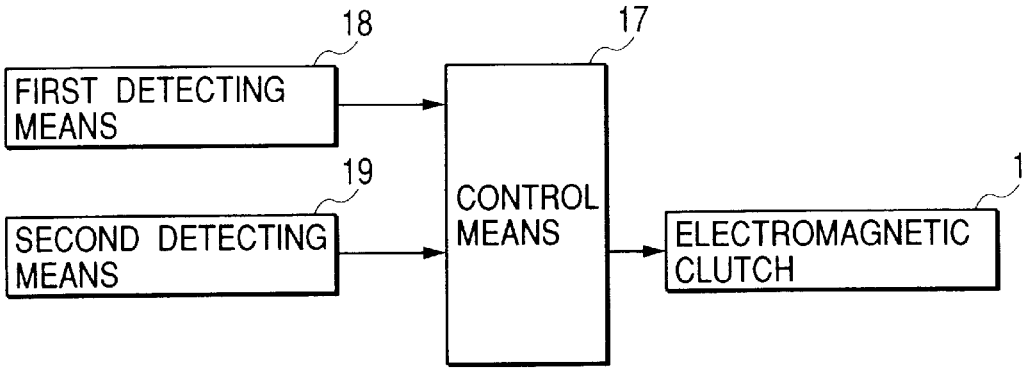
FIG. 6 is a control block diagram showing the sheet feeding apparatus according to the first embodiment of the present invention.

As is shown in FIG. 6, the ON/OFF state of the electromagnetic clutch 1 is controlled by a controller 17. The controller 17 turns off the electromagnetic clutch 1 on the basis of a detecting signal from a first detecting means 18 detecting that the distance between the trailing end of the preceding recording sheet P1 and the nips N of the rollers 4 and 5 comes to a. And subsequently, the controller 17 turns on the electromagnetic clutch 1 on the basis of a detecting signal from a second detecting means 19 detecting that the trailing end of the preceding recording sheet P1 passed through the nips N.

The sequential sheet feeding operation performed by the thus arranged sheet feeding apparatus will now be described.

When the sequential sheet feeding operation is stated, first, the topmost recording sheet P1 among the recording sheets P contained in the sheet feeding cassette 8 is fed, as the current recording sheet, to the sheet feed rollers 5. Also, when the preceding recording sheet P1 is fed, the succeeding recording sheet P2 is conveyed to a position near the nips N of the rollers 4 and 5 as is shown in FIG. 4.

While the preceding recording sheet P1 is conveyed by a constant distance, the retard rollers 4 are rotated in the direction opposite to the conveying direction of the sheet feed rollers 5. Thus, if the succeeding recording sheet P2 is conveyed with the preceding recording sheet P1 by the sheet feed rollers 5, the retard rollers 4 can separate the succeeding recording sheet P2 from the preceding recording sheet P1 and return it to a position near the nips N.

So long as only the preceding recording sheet P1 is conveyed, the retard rollers 4 is driven to be rotated with the sheet feed rollers 5 by the torque limiter 2, and the conveying of the preceding recording sheet P1 by the sheet feed rollers 5 can proceed without any interference by the retard rollers 4.

When the trailing end of the preceding recording sheet P1 has passed the pickup roller 9, the pickup roller 9 feeds out the succeeding recording sheet P2 and conveys the leading end to a position near the nips N between the sheet feed rollers 5 and the retard rollers 4. Incidentally, even if the succeeding recording sheet P2 passes through the nips N between the sheet feed rollers 5 and the retard rollers 4 by being driven with the preceding recording sheet P1, it is immediately drawn back by the retard rollers 4.

Following this, when, as is shown in FIG. 4, the distance between the trailing end of the preceding recording sheet P1 and the nips N of the rollers 4 and 5 comes to a, and the first detecting means which detects this distance outputs a detection signal to the controller 17, the controller 17 turns off the electromagnetic clutch 1 on the basis of the detection signal.

When the electromagnetic clutch 1 is turned off, the retard rollers 4 begin to be driven to be rotated with the sheet feed rollers 5, and the succeeding recording sheet P2, which has conveyed near the nips N with the preceding recording sheet P1 is conveyed while overlapping with the preceding recording sheet P1.

Thereafter, when the trailing end of the preceding recording sheet P1 passed through the nips N, the second detecting means 19 detects the trailing end of the preceding recording sheet P1, a detection signal is input to the controller 17 from the second detecting means 19, and the controller 17 turns on the electromagnetic clutch 1. As a result, the retard rollers 4 begin to rotate again, so that when three or more recording sheets started to be conveyed together, the third and the following recording sheets are drawn back to the nips N of the sheet feed rollers 5 by the retard rollers 4, and an operation can be performed without any interference being encountered.

As is described above, during the sequential sheet feeding operation, the sheet feed rollers 5 are constantly rotated while the electromagnetic clutch 1 is turned on or off, so that the conveying of the preceding recording sheet P1 and the succeeding recording sheet P2 can proceed while the sheets overlap each other. As a result, the sheet feed interval can be reduced and requests for higher processing speeds can be coped with.

When the timing for turning on or off the electromagnetic clutch 1 is changed, an arbitrary overlap distance for the preceding recording sheet P1 and the succeeding recording sheet P2 and an arbitrary sheet feeding interval can be set, and in addition, stable sheet feeding can be performed without being unstable condition caused by that the sheet feeding interval is plus or minus. Furthermore, when the distance a between the trailing end of the preceding recording sheet P1 and the nips N is set to 0, a sheet feeding interval of substantially 0 can be obtained, and stable sheet feeding at tiny sheet feeding intervals can be performed.

When the electromagnetic clutch 1 is constantly turned on, the recording sheets can be fed at a sheet feeding interval of 0, and thus, the electromagnetic clutch 1 is not required for an apparatus that constantly feeds recording sheets at a sheet feeding interval of 0.

In the above explanation, the succeeding recording sheet P2 is conveyed by the pickup roller 9 to a location near the nips N between the sheet feed rollers 5 and the retard rollers 4. However, so long as the succeeding recording sheet P2 can be conveyed near the nips N, a sheet feeding means having another arrangement can be employed.

Figure 7:
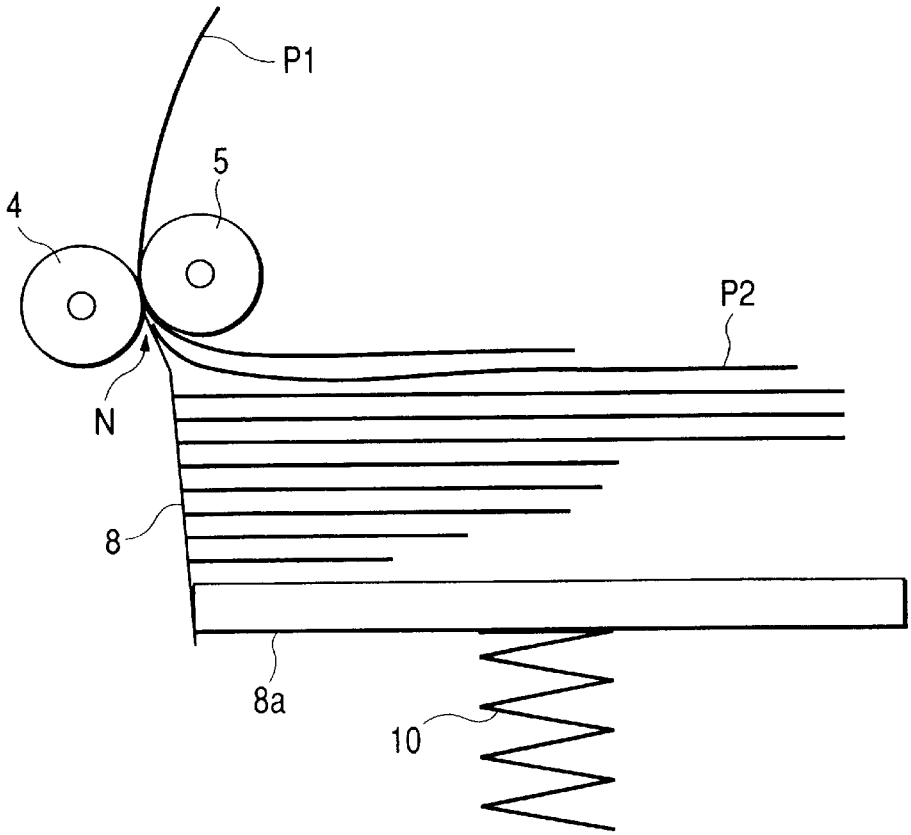
FIG. 7 is a diagram showing another example of sheet feeding means according to the first embodiment of the present invention for the feeding of a succeeding sheet by the sheet feeding apparatus.

For example, as is shown in FIG. 7, a sheet feeding cassette 8 may be located below the nips N between the rollers 4 and 5, and a sheet stacking board 8*a,* sheet supporting means which is provided for the paper cassette 8 and which can raise and lower recording sheets P, may be pushed upward by urging means 10, so that the recording sheets P mounted on the sheet stacking board 8*a* are positioned just below the nip N.

Further, when a preceding recording sheet P1 is conveyed by the sheet feed rollers 5 and the sheet stacking board 8*a* is held at an angle, by the urging means 10, at which a succeeding recording sheet P2 can be conveyed by friction from the preceding recording sheet P1 so that they overlap each other. Then, as the preceding recording sheet P1 is conveyed, the succeeding recording sheet P2 is accordingly conveyed to a location near the nips N, as is shown in FIG. 7.

In the above explanation, the trailing end of the preceding recording sheet P1 is detected by the first and the second detecting means 18 and 19. If the detection of the trailing end by the detecting means is difficult, however, the controller 17, for example, may, by measuring the time since the sheet feeding operation started, turn off the electromagnetic clutch 1 when the distance between the nip N and the trailing end of the preceding recording sheet P comes to a, and turn on the electromagnetic clutch 1 when the trailing end of the preceding recording sheet P1 passed through the nips N. The timing for turning the electromagnetic clutch 1 on or off is determined in advance in accordance with the size of the recording sheet P.

A second embodiment of the present invention will now be described.

Figure 8:
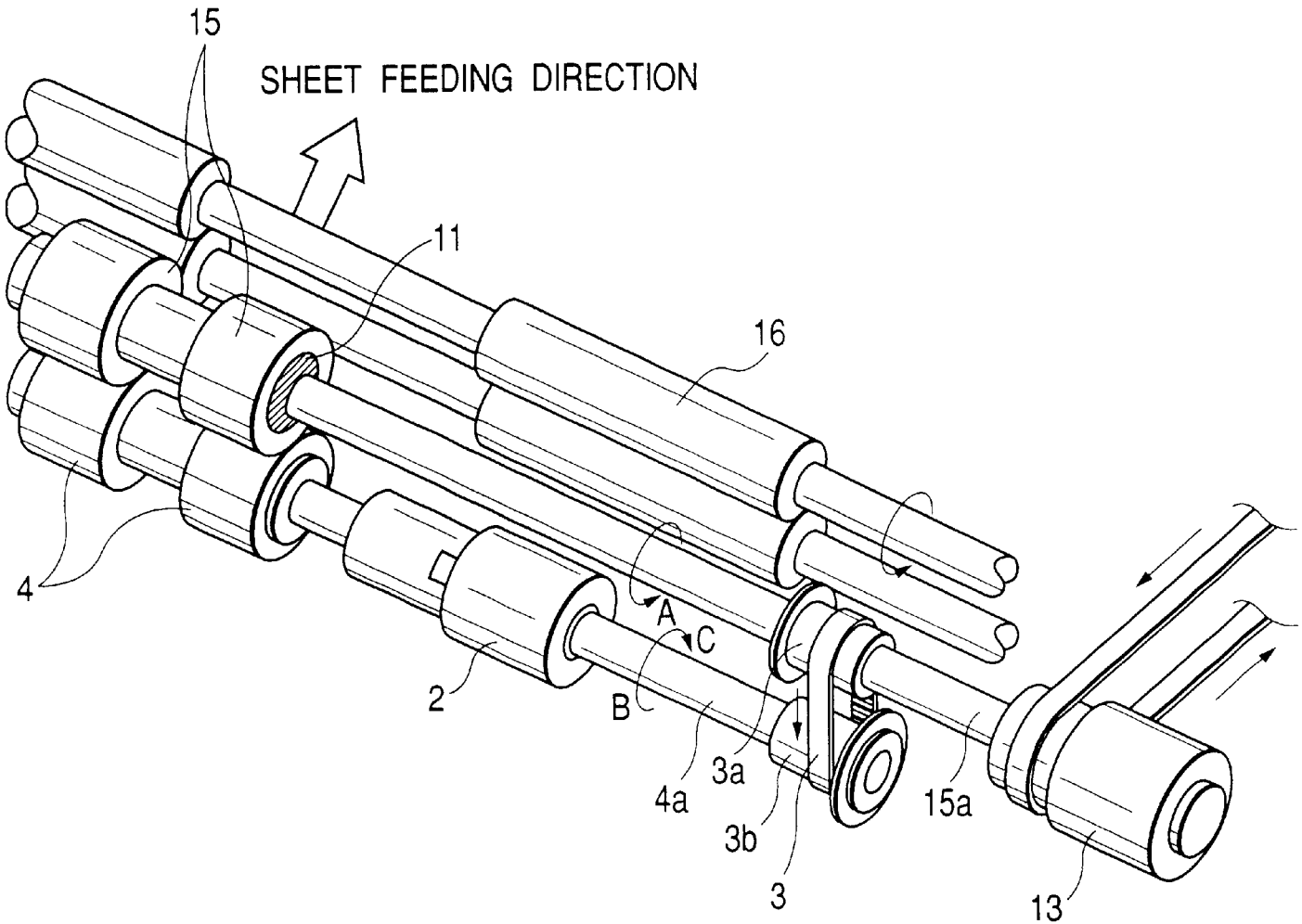
FIG. 8 is a perspective view of the essential portion of a sheet feeding apparatus according to a second embodiment of the present invention.

FIG. 8 is a perspective view of the essential portion of a sheet feeding apparatus according to the second embodiment of the present invention. The same reference numerals as are used in FIG. 2 are also used in FIG. 8 to denote identical or corresponding components.

Figure 9:
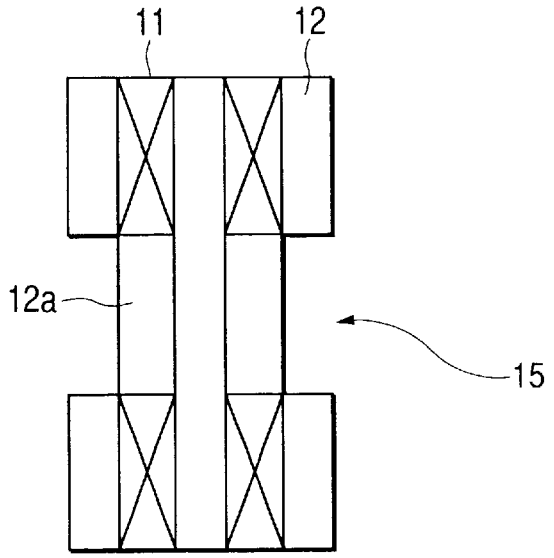
FIG. 9 is a cross-sectional view of a one-way mechanism for the sheet feeding rollers of the sheet feeding apparatus according to the second embodiment of the present invention.

In FIG. 8, drawing rollers 16 are located immediately downstream of sheet feed rollers 15. As is shown in FIG. 9, the sheet feed rollers 15 are formed by fitting rubber rollers 12 around a roller collar 12*a* that includes one-way clutches 11. When a force acts on the sheet feed rollers 15 from the drawing roller side while a feed roller shaft 15*a* is halted, the sheet feed rollers 15 run free.

In FIG. 8, an electromagnetic clutch 13 is fitted around the feed roller shaft 15*a*. As will be described later while referring to FIG. 11, the electromagnetic clutch 12 is turned off when the distance from the trailing end of a preceding recording sheet P1 to nips N between the rollers 4 and 15 comes to b.

When the electromagnetic clutch 13 is turned off, no driving force is transmitted to the sheet feed rollers 15, and when at this time the drawing rollers 16 pull the recording sheet P, the sheet feed rollers 15 are rotated in the direction indicated by an arrow A, and retard rollers 4 is driven to be rotated with the sheet feed rollers 15 in the direction indicated by an arrow C. When the retard rollers 4 are thus driven to be rotated, similarly to the first embodiment, the succeeding recording sheet P2 that has been conveyed to the vicinity of the nips N by a pickup roller 9 is pulled by the force of the friction generated by the preceding recording sheet P1, and is conveyed while overlapping the preceding recording sheet P1.

The electromagnetic clutch 13 is turned on again when the trailing end of the current recording sheet P1 has passed through the nips N. Thus, the separation operation performed by the retard rollers 4 is resumed, so that even if three or more recording sheets were conveyed together, the third and the following sheets are drawn back to the nips N of the sheet feed rollers 15.

As is described above, during the sequential sheet feeding operation, the electromagnetic clutch 1 is turned on and off to pull the recording sheet P out using the drawing rollers 16, so that the preceding recording sheet P1 and the succeeding recording sheet P2 can be conveyed while they are overlapped.

The sequential sheet feeding operation performed by the thus arranged sheet feeding apparatus will now be described while referring to FIGS. 10 and 11.

Figure 10:
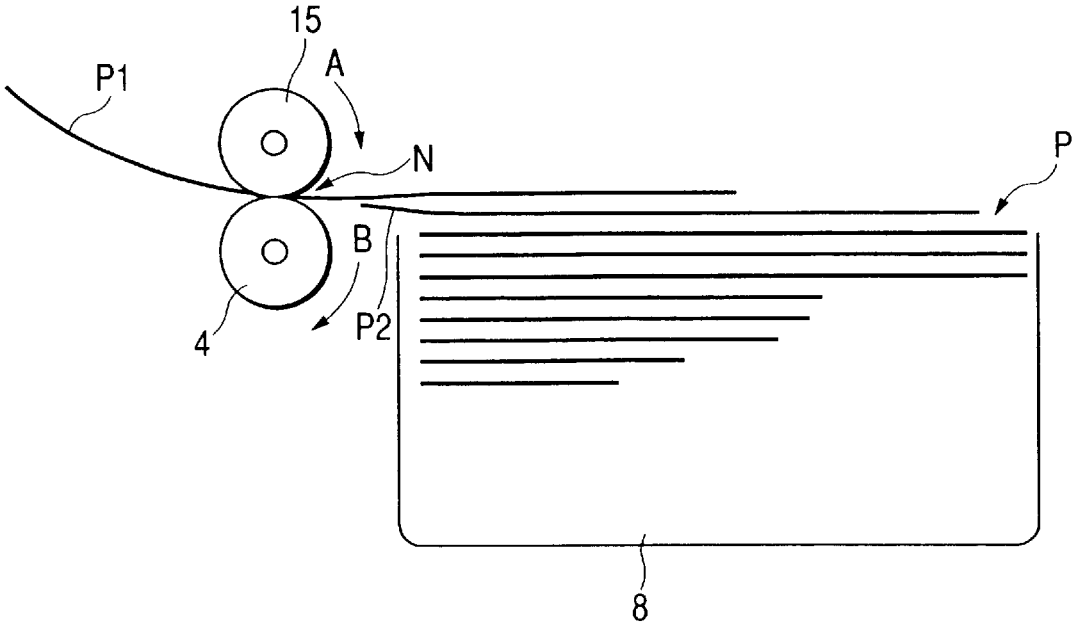
FIG. 10 is a diagram for explaining the sequential sheet feeding operation performed by the sheet feeding apparatus according to the second embodiment of the present invention.

When the sheet feeding operation is started, as is shown in FIG. 10, the topmost recording sheet P1 among the recording sheets P contained in the sheet feeding cassette 8 is fed as a preceding recording sheet P by the sheet feed rollers 15. While the preceding recording sheet P1 is fed, as is shown in FIG. 10, the succeeding recording sheet P2 is conveyed by the convey means described in the first embodiment so it is conveyed to near the nips N between the sheet feed rollers 15 and the retard rollers 4.

While the preceding sheet P1 is conveyed a constant distance, the retard rollers 4 are rotated in a direction B, which is the opposite of a direction A in which the sheet feed rollers 15 are rotated. And thus, when the succeeding recording sheet P2 and conveyed with the preceding recording sheet P1 are by the sheet feed rollers 15, the retard rollers 4 separate the succeeding recording sheet P2 from the sheet P1, and return it to a location near the nip N.

However, when only the preceding recording sheet P1 is conveyed, a torque limiter 2 permits the retard rollers 4 to be driven to be rotated with the sheet feed rollers 15, so that the conveying of the preceding recording sheet P1 by the sheet feed rollers 5 can proceed without any interference by the retard rollers 4.

Figure 11:
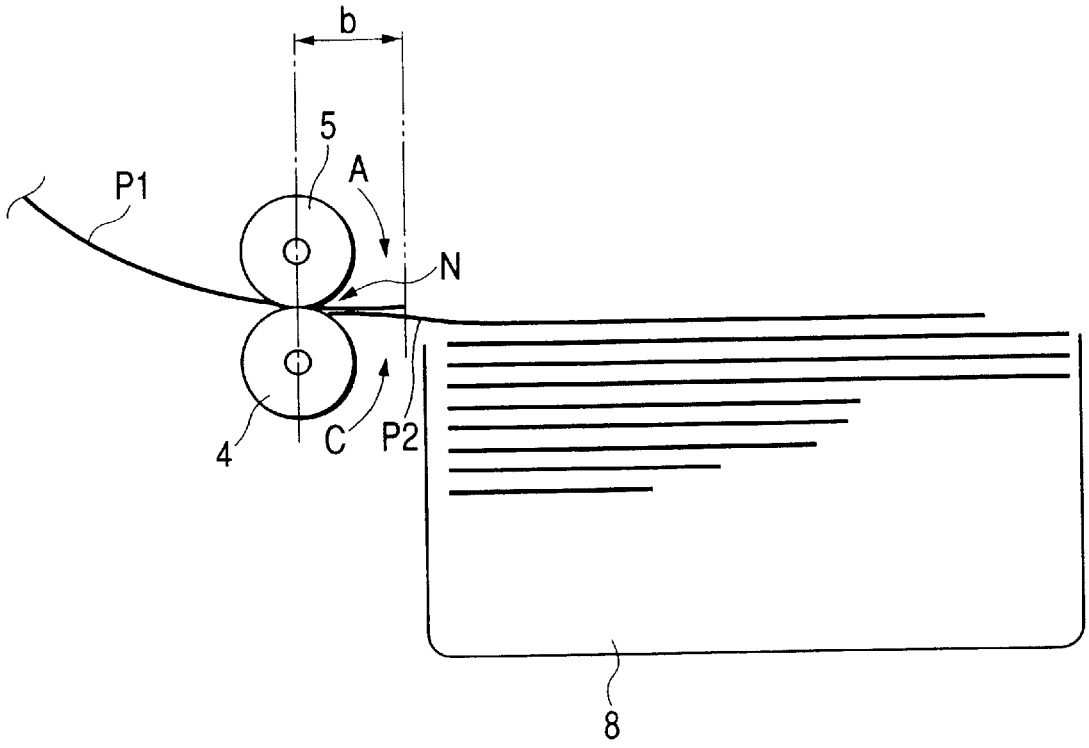
FIG. 11 is a diagram for explaining the sequential sheet feeding operation performed by the sheet feeding apparatus according to the second embodiment of the present invention.

Next, as is shown in FIG. 11, when the distance from the trailing end of the preceding recording sheet P1 to the nips N between the rollers 4 and 15 comes to b, a controller 17. turns the electromagnetic clutch 13 off and cuts the driving force input to the sheet feed roller shaft 15*a*. In this state, the preceding recording sheet P1 is drawn out by the drawing rollers 16, and accordingly, the sheet feed rollers 15 idled, in the direction indicated by the arrow A, by the preceding recording sheet P1 to be drawn.

When the sheet feed rollers 15 idled, the retard rollers 4 starts to be driven to be rotated with the sheet feed roller 15 in the direction indicated by an arrow C, and the succeeding recording sheet P2, which is conveyed to near the nips N of the rollers 4 and 15 with the preceding recording sheet P1 while the two sheets overlap.

Thereafter, when the trailing end of the preceding recording sheet P1 passed through the nips N, the controller 17 turns on the electromagnetic clutch 13. As a result, when the sheet feed rollers 15 and the retard rollers 4 are again rotated, even if three or more recording sheets were being conveyed together, the third and the following recording sheets can be drawn back to a location near the nips N between the two rollers 4 and 15 by the retard rollers 4, so that the operation is performed without any interference being encountered.

As is described above, during the sequential sheet feeding operation, the electromagnetic clutch 13 is turned on or off when the drawing rollers 16 draws the recording sheet P, so that the preceding recording sheet P1 and the succeeding recording sheet P2 can be conveyed while overlapping each other. Therefore, the sheet feeding interval can be reduced, and requests for higher processing speeds can be coped with.

In addition, when the timing for turning on and off the electromagnetic clutch 13 is changed, an arbitrary sheet feeding interval can be set, and stable sequential sheet feeding can be performed without being unstable condition caused by the sheet feeding interval is plus or minus. Furthermore, since the distance b between the trailing end of the preceding recording sheet P1 and the nip N is set to 0, a sheet feeding interval of substantially 0 (no gaps between the recording sheets) can be obtained, and sheet feeding at tiny intervals can be implemented.

In the second embodiment, to feed the succeeding recording sheet P2 to the nip N, the same pickup roller as is used in the first embodiment may be employed, or the sheet feeding out means shown in FIG. 7 may be employed.

Specific arrangements for the sheet feeding cassette 8 and the pickup roller 9 in the first embodiment will now be described.

The sheet feeding cassette 8 is provided detachably attachable for the main body Xa, and as is shown in FIG. 5, the sheet stacking board 8*a* is provided to support the recording sheets. The sheet stacking board 8*a* can be moved vertically, parallel to the paper cassette 8, by a lifter mechanism (not shown). Further, a sheet top face sensor 20 is provided for the main body Xa to detect the topmost location of the recording sheets P mounted on the sheet stacking board 8*a*. The sheet top face sensor 20 detects the location of the top face of the topmost recording sheet P that faces the pickup roller 9. The pickup roller 9 is maintained at a constant height.

With this arrangement, when the conveyance of the first sheet is begun by the retard rollers 4 and the sheet feed rollers 5, a gap equivalent to the thickness of one recording sheet is defined between the pickup roller 9 and the second recording sheet. Then, the sheet top face sensor 20, which detects whether the sheet is located at a constant height, detects the second sheet, which is then the topmost one, and that the sheet is not located at a predetermined height. Therefore, the sheet stacking board 8*a* is raised to position, thereby the second sheet is raised at the predetermined height, and to bring it into contact with the pickup roller 9.

With this arrangement, the sheet stacking board 8*a* is controlled to be raised each time one recording sheet is fed. The sheet stacking board 8*a* may also be raised an each time a plurality of recording sheets are fed out.

An explanation will now be given for means for changing the position of the pickup roller 9 in accordance with the size of a recording sheet. In the first embodiment, the driving force is transmitted to the retard rollers 4 by the pulleys 3 and 3*b* and the drive input belt 3. In the embodiment shown in FIG. 12, gears 24 and 25 are employed to transmit the driving force.

Figure 12:
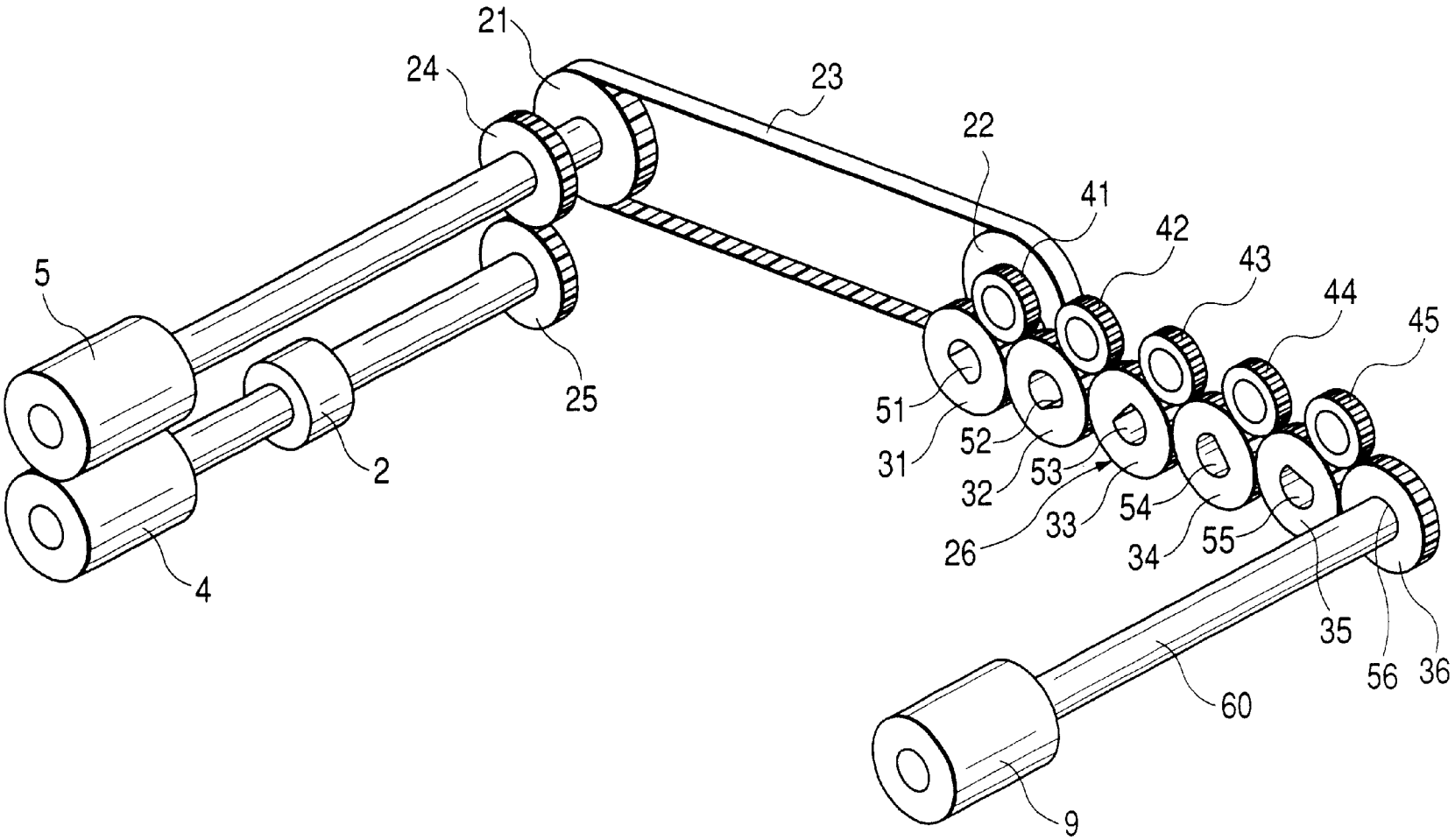
FIG. 12 is a diagram for explaining the arrangement for changing the locations of the pickup rollers in the sheet feeding apparatus according to the first embodiment of the present invention.

FIG. 12 is a perspective view of a driving force transmission system for each roller of the sheet feeding apparatus. In the sheet feeding apparatus, the pickup roller 9, the sheet feed rollers 5 and the retard rollers 4 are rotated by a common drive source (not shown).

Toothed pulleys 21 and 22 are interlocked or linked by a toothed belt 23, and one of the pulleys 21 and 22 is connected to a motor (not shown) as the drive source.

The retard rollers 4 receives rotational force by mating of a gear 24 that is coaxially arranged with the toothed pulley 21 with a gear 25, which is coaxially arranged with the retard rollers 4.

The pickup roller 9 receives rotational force from the toothed pulley 22 via a train of gears 26 constituting position adjustment means. The train of gears 26 includes rotatable drive gears 31 to 36 and idler gears 41 to 45 that are alternately provided along a side plate (not shown).

Figure 13:
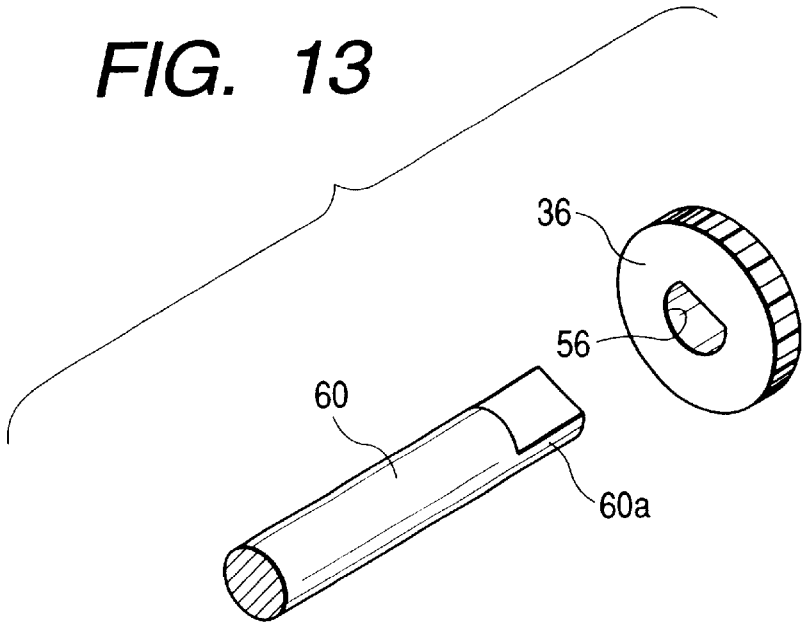
FIG. 13 is a diagram for explaining the structure used for the attaching/detaching of the pickup rollers.

D-shaped engagement holes 51 to 56 to be engaged are formed in the centers of the drive gears 31 to 36. And as is shown in FIG. 13, the distal end 60*a*, which in cross section is D-shaped, of a drive shaft 60 for the pickup roller 9 is selectively inserted into one of the engagement holes 51 to 56.

In FIG. 12, the pickup roller 9 is provided on the drive gear 36 for A3 size paper. In FIG. 12, the drive gear 33 is for LTR (letter) size paper, the drive gear 32 is for A4 size paper, the drive gear 31 is for B5 size paper, and the drive gears 34 and 35 are for other, special sizes of paper. The distal end 60*a* of the drive shaft 60 of the pickup roller 9 can be inserted into engagement holes, 51 to 56 respectively corresponding to the size of each recording sheet, regardless of the length of a recording sheet, the position of the pickup roller 9 can be set so that its distance downstream from the trailing end of each recording sheet corresponds to positions which is parted by the distance c.

Figure 14:
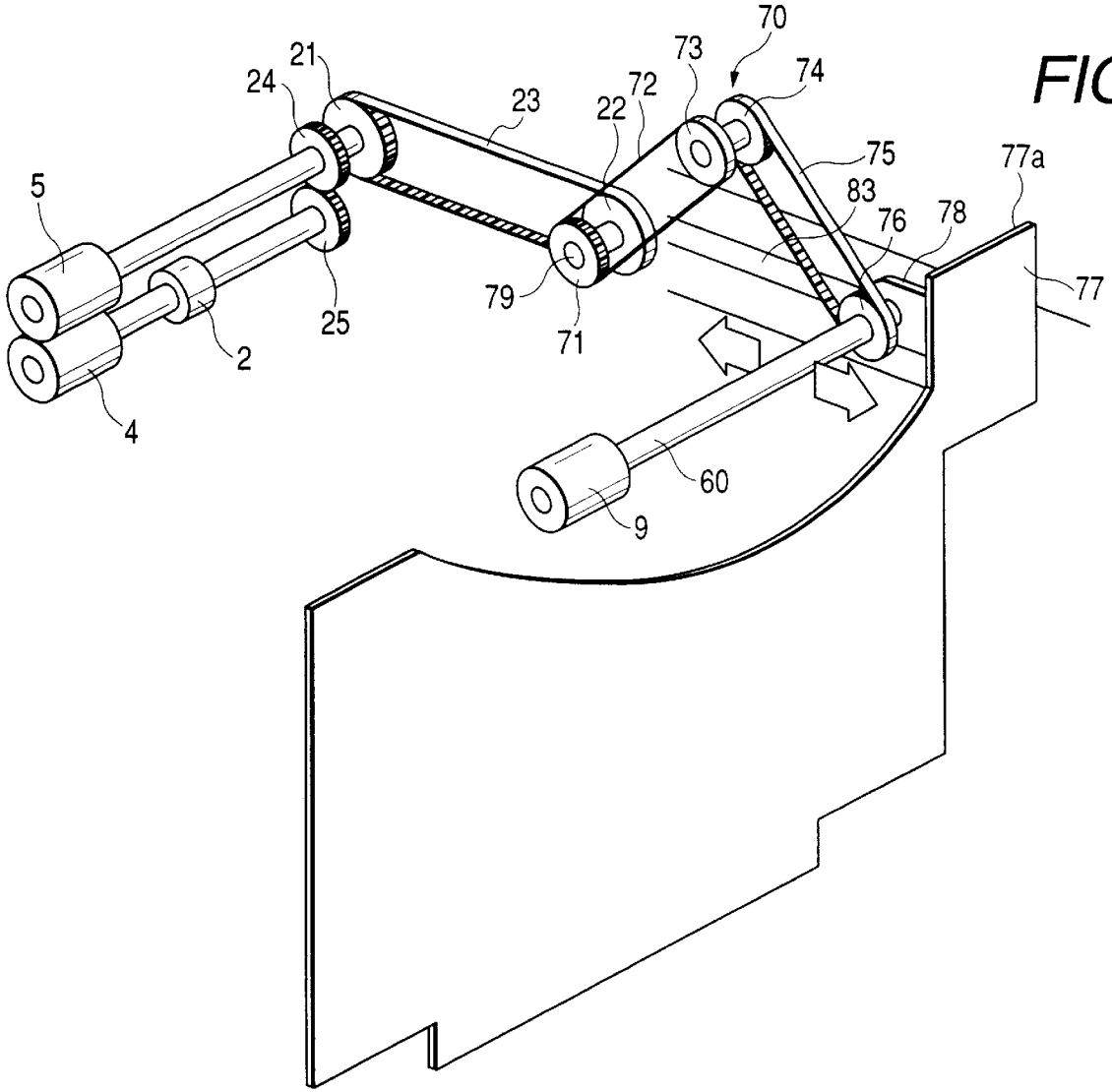
FIG. 14 is a diagram for explaining another arrangement for changing the locations of the pickup rollers.
Figure 15:
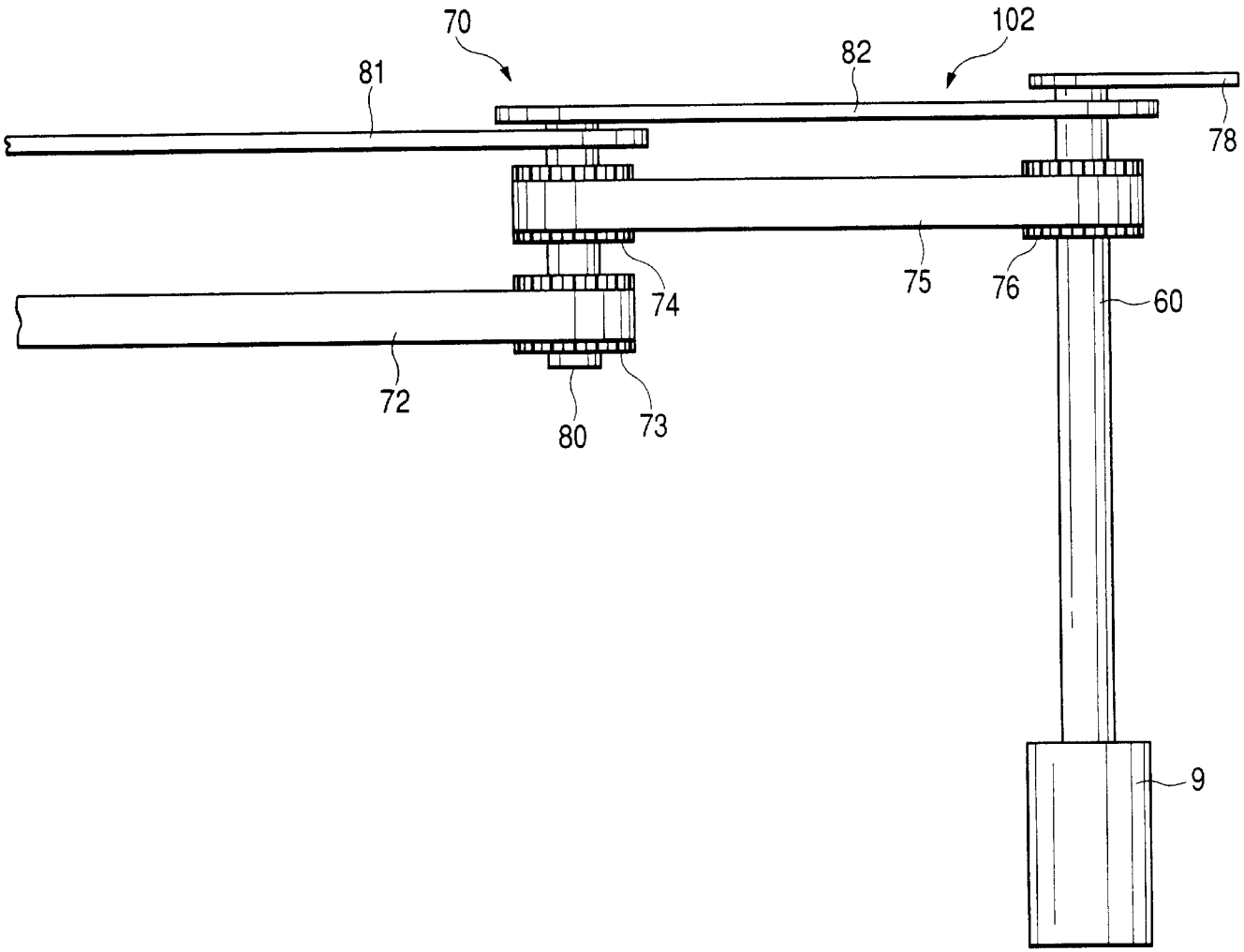
FIG. 15 is a plan view of the arrangement in FIG. 14 for changing the locations of the pickup rollers.
Figure 16:
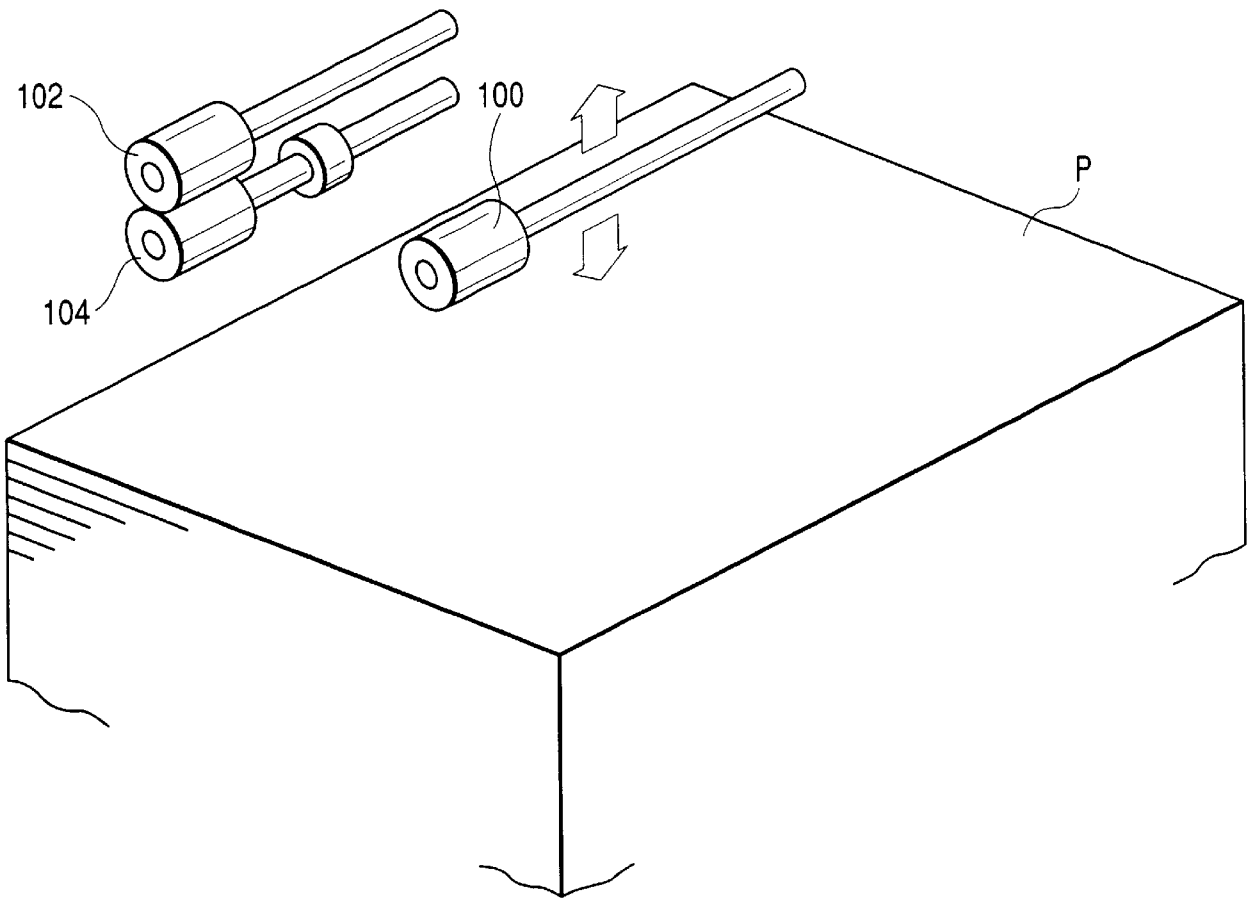
FIG. 16 PRIOR ART
FIG. 16 is a perspective view of the essential portion of a conventional sheet feeding apparatus.
Figure 17:
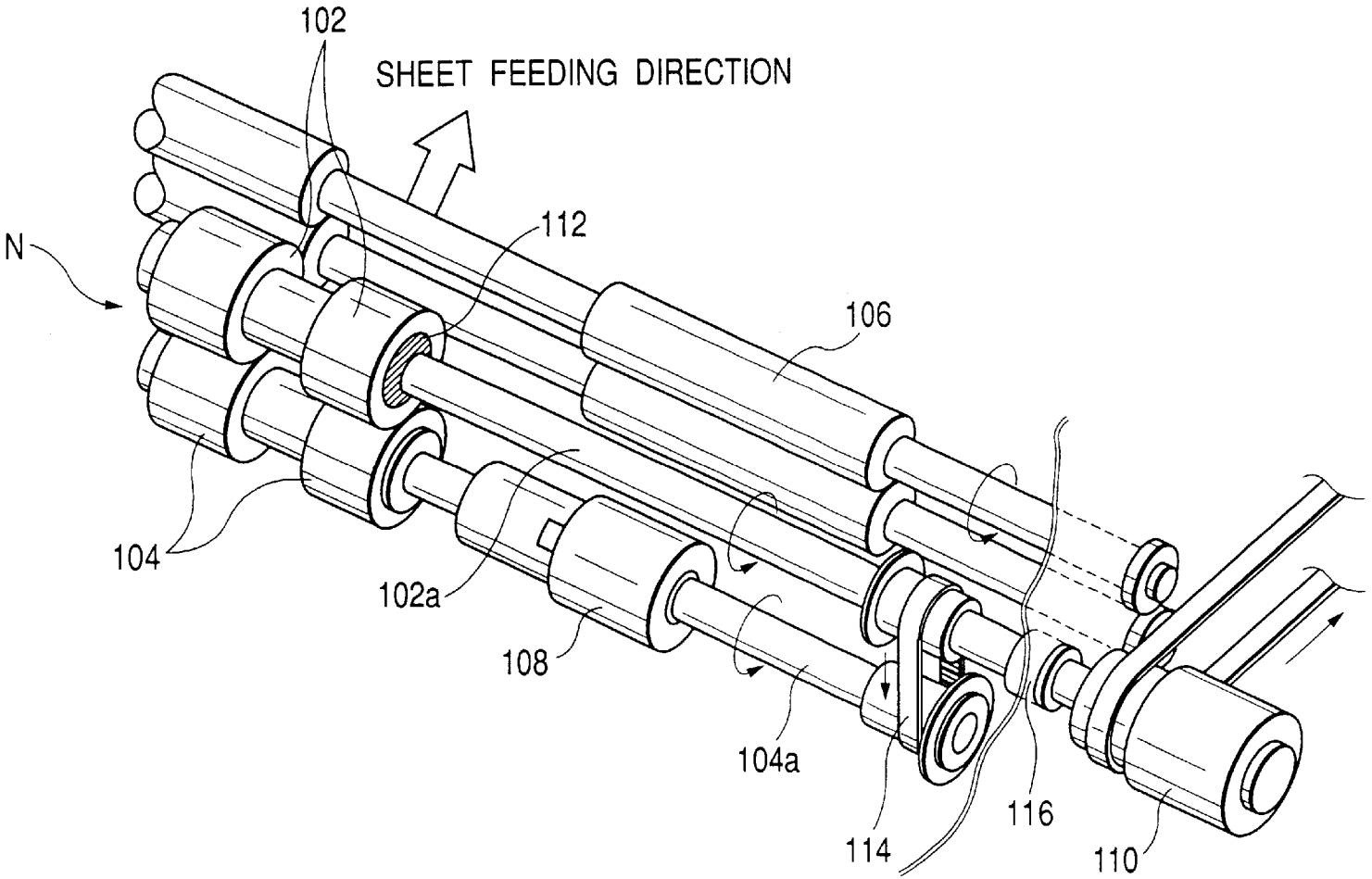
FIG. 17 PRIOR ART
FIG. 17 is a perspective view of the conventional sheet feeding apparatus.

FIGS. 14 and 15 are diagrams showing another arrangement for changing the position of the pickup roller 9.

The toothed pulleys 21 and 22 are interlocked by the toothed belt 23, and one of these pulleys is connected to a motor (not shown), the drive source.

The retard rollers 4 by receives rotational force by mating of the gear 24, which is coaxially arranged with the toothed pulley 21 with the gear 25, which is coaxially arranged with the retard rollers 4.

The pickup roller 9 receives rotational force from the toothed pulley 22 via a belt pulley drive linking mechanism 70 constituting the position adjustment means.

The belt pulley drive linking mechanism 70 is constituting by a toothed pulley 71 which is coaxially arranged with the toothed pulley 22, a toothed belt 72 which is fitted around the toothed pulley 71, a toothed pulley 73 which engages the toothed belt 72, a toothed pulley 74 which is coaxially arranged with the toothed pulley 73, a toothed belt 75 which is fitted around the toothed pulley 74, a toothed pulley 76 which engages the toothed belt 75 and which is coaxially arranged with the pickup roller 9 and the like.

A feed roller securing plate 78 having a sheet trailing end regulation plate 77 is rotatably provided on the drive shaft 60 of the pickup roller 9. The feed roller securing plate 78 can slide along a guide plate 83 in the sheet feeding direction.

The sheet trailing end regulation plate 77 abuts against the trailing end of a sheet, and the distance between the axial center of the drive shaft 60 and a face 77*a* where the trailing end regulation plate 77 abuts against the sheet, is set to c.

The distance between a shaft 79 for the toothed pulleys 22 and 71 and a shaft 80 for the toothed pulleys 73 and 74 is maintained constant by a shaft couple link 81 that rotatably couples the shafts 79 and 80. Similarly, the distance between the shaft 80 and the drive shaft 60 is maintained constant by a shaft couple link 82 that rotatably couples the shaft 80 and the drive shaft 60.

With this arrangement, when the shaft couple links 81 and 82 are bent and the feed roller securing support plate 78 slides along the guide plate 83, the sheet trailing end regulation plate 77 abuts against the trailing end of a recording sheet, and the pickup roller 9 is automatically or naturally positioned at a position parted by the distance of c from the trailing end of the sheet corresponds.

In the above embodiments, the present invention is applied for a sheet feeding apparatus that supplies recording sheets to an image forming apparatus, but the present invention may also be applied for an automatic document feeder (ADF) that supplies documents to an image reading apparatus.

What is claimed is:

1. A sheet feeding apparatus comprising:

a sheet support for supporting sheets;

separation means comprising a sheet feed roller rotating in a sheet feeding direction and a retard roller rotating in a direction opposite to the sheet feeding direction, said separation means for separating and conveying sheets stacked on said sheet support one by one; and sheet feeding out means for feeding out a succeeding sheet to an abutting portion of said sheet feed roller and said retard roller while a preceding sheet is conveyed by said sheet feed roller and said retard roller, wherein when a trailing end of the preceding sheet approaches a position spaced from the abutting portion of said sheet feed roller and said retard roller by a predetermined distance, said retard roller is rotated by a rotation of said sheet feed roller in order to convey the preceding sheet and the succeeding sheet with the preceding sheet overlapping the succeeding sheet.

2. A sheet feeding apparatus according to claim 1, wherein said sheet feeding out means is a pickup roller located downstream from the trailing end of a sheet supported by said sheet support at a distance substantially the same as a distance between the abutting portion of said sheet feed roller and said retard roller and the leading end of the sheet.

3. A sheet feeding apparatus according to claim 2, further comprising:

position adjustment means for changing a position of said pickup roller in a sheet feeding direction, in accordance with a size of the sheets supported by said sheet support.

4. A sheet feeding apparatus according to claim 3, wherein said position adjustment means includes a train of gears that are arranged in the sheet feeding direction and that transmit a rotational force to said pickup roller, and wherein said gears of said train are positioned in accordance with each different sheet length, and said pickup roller can be loaded into and unloaded from each of said gears.

5. A sheet feeding apparatus according to claim 3, wherein said position adjustment means includes a trailing end regulation member for regulating a position of the trailing end of the sheet to move the sheet in the sheet feeding direction, and wherein said pickup roller is provided, to said trailing end regulation member, upstream in the sheet feeding direction at a distance substantially equal to an interval between said separation means and the leading end of a sheet on said sheet support.

6. A sheet feeding apparatus according to claim 2, wherein said pickup roller is constantly rotated in a sheet feeding.

7. A sheet feeding apparatus according to claim 1, wherein the sheet support is adapted to ascend and descend, and further comprising:

biasing means for biasing said sheet support so as to move said sheets to the vicinity of the abutting portion of said sheet feed roller and said retard roller, wherein, when a sheet is conveyed by said feeding roller, said biasing means maintains said sheet support at an angle at which the succeeding sheet is conveyed with the sheet in a condition where the succeeding sheet is overlapped by the preceding sheet.

8. A sheet feeding apparatus according to claim 7, further comprising:

sheet detecting means for detecting a height of sheets supported by said sheet support, wherein said biasing means is controlled in accordance with the detected height of the recording sheets in order to maintain a constant sheet height.

9. A sheet feeding apparatus according to claim 1, further comprising:

a torque limiter for cutting a transmission of torque having an amount equal to or greater than a predetermined amount to drive force transmission means which transmits a drive to said retard roller; and a clutch for putting the transmission of the driving on/off, wherein said retard roller is driven to be rotated with said sheet feed roller when said clutch halts the transmission of said driving force.

10. A sheet feeding apparatus according to claim 9, further comprising:

first detecting means for detecting that the trailing end of the preceding sheet when the trailing end is at the predetermined distance from the abutting portion of said sheet feed roller and said retard roller, wherein said retard roller is driven to be rotated by turning off said clutch on the basis of the detection performed by said first detecting means.

11. A sheet feeding apparatus according to claim 10, further comprising:

second detecting means for detecting the trailing end of the preceding sheet when the trailing end has passed through a nip formed by said sheet feed roller and said retard roller, wherein, on the basis of the detection performed by said second detecting means, said clutch is turned on and the driving is transmitted to said retard roller.

12. A sheet feeding apparatus according to claim 9, wherein a period that begins when sheet feeding operation is started is measured, wherein, at a timing when the trailing end of the preceding sheet reaches at a location where it is the predetermined distance from the abutting portion of said sheet feed roller and said retard roller, said clutch is turned off to drive said retard roller to be rotated with said sheet feed roller, and wherein, at a timing when the trailing end of the preceding sheet has passed through between said sheet feed roller and said retard roller, said clutch is turned on to transmit the drive to said retard roller.

13. A sheet feeding apparatus according to claim 1, further comprising:

a retard roller shaft around which said retard roller is securely fixed;

a rotation drive input portion for inputting a rotation drive of said sheet feed roller to said retard roller shaft;

a clutch, provided at said retard roller shaft, for selectively transmitting, to said retard roller shaft, the rotation drive of said sheet feed roller inputted to said rotation drive input portion; and a torque limiter, located between said clutch and said retard roller, for cutting the transmission of a torque equal to or greater than a predetermined amount, wherein said sheet feed roller is constantly rotated, and, when the trailing end of the succeeding sheet approaches the location where it is the predetermined distance from the abutting portion of said sheet feed roller and said retard roller, transmission of the rotation drive to said retard roller is cut by said clutch and said retard roller is driven to be rotated with said sheet feed roller.

14. A sheet feeding apparatus according to claim 1, further comprising:

a drawing roller, located downstream of said sheet feed roller and said retard roller, for drawing a sheet separated by said sheet feed roller and said retard roller, wherein, when the preceding sheet is drawn by said drawing roller, said retard roller is driven to be rotated, so that the preceding sheet and the succeeding sheet are conveyed in a condition where they overlap each other.

15. A sheet feeding apparatus according to claim 14, further comprising:

a one-way clutch, located between said sheet feed roller and a sheet feed roller shaft for supporting said sheet feed roller, for rotating said sheet feed roller only in a sheet feeding direction; and a clutch for putting on/off a transmission of a drive to driving force transmission means that transfer a drive to said sheet feed roller shaft, wherein, when the sheet is drawn by said drawing roller, said sheet feed roller and said retard roller are driven to be rotated with the sheet drawn, by putting off said clutch.

16. A sheet feeding apparatus according to claim 1, wherein said sheet feeding roller is sequentially rotated in sequential sheet feeding, so that the preceding sheet and the succeeding sheet are conveyed with an interval of 0 therebetween.

17. An image forming apparatus comprising:

a sheet support for supporting sheets;

separation means comprising a sheet feed roller rotating in a sheet feeding direction and a retard roller rotating in a direction opposite to the sheet feeding direction, said separation means for separating and conveying sheets stacked on said sheet support one by one;

sheet feeding out means for feeding out a succeeding sheet to an abutting portion of said sheet feed roller and said retard roller while a preceding sheet is conveyed by said sheet feed roller and said retard roller, wherein when a trailing end of the preceding sheet approaches a position spaced from the abutting portion of said sheet feed roller and said retard roller by a predetermined distance, said retard roller is rotated by a rotation of said sheet feed roller in order to convey the preceding sheet and the succeeding sheet with the preceding sheet overlapping the succeeding sheet; and image forming means for forming an image on the sheet that is separated and fed by said separation means.

* * * * *

UNITED STATES PATENT AND TRADEMARK OFFICE

CERTIFICATE OF CORRECTION

PATENT NO. : 6,332,608 B1
DATED : December 25, 2001
INVENTOR(S) : Masashige Tamura It is certified that error appears in the above-identified patent and that said Letters Patent is hereby corrected as shown below:

Column 5,
Line 32, "is" should read -- are --.

Column 6,
Line 60, "is" should read -- are --.

Column 10,
Line 56, "receives" should read -- receive --.

Signed and Sealed this

Twenty-first Day of May, 2002

*Attest:*

*Attesting Officer*

JAMES E. ROGAN
*Director of the United States Patent and Trademark Office*